US005172172A

United States Patent [19]

Amemiya et al.

[11] Patent Number: 5,172,172

[45] Date of Patent: Dec. 15, 1992

[54] IMAGE FORMING APPARATUS

[75] Inventors: Koji Amemiya, Tokyo; Takashi Hasegawa, Ageo, both of Japan

[73] Assignee: Canon Kabushiki Kaisha, Tokyo, Japan

[21] Appl. No.: 843,156

[22] Filed: Feb. 28, 1992

[30] Foreign Application Priority Data

Feb. 28, 1991 [JP] Japan ..... 3-058016

[51] Int. Cl.[5] ..... G03G 15/16

[52] U.S. Cl. ..... 355/271; 355/274; 355/277; 355/326

[58] Field of Search ..... 355/271-274, 355/276, 277, 326, 327

[56] References Cited

U.S. PATENT DOCUMENTS 4,935,776 6/1990 Fukui ..... 355/274 X
5,053,826 10/1991 Castelli et al. ..... 355/271
5,081,501 1/1991 Waki et al. ..... 355/274
5,083,167 1/1992 Fukushima et al. ..... 355/274
5,084,736 1/1992 Suzuki et al. ..... 355/271
5,091,751 2/1992 Inoue et al. ..... 355/274

*Primary Examiner*—Richard L. Moses

[57] ABSTRACT

An image forming apparatus includes an image forming device for forming an image on a recording material in an image forming position. A recording material feeder is provided for feeding the recording material to the image forming position, the recording material feeder including a recording material carrying member for carrying the recording material. A supply device is provided for supplying the recording material to the recording material carrying member at a recording material supply position, a first urging member urges a second surface of the recording material carrying member which is opposite from a first surface thereof for carrying the recording material in the recording material supply position, and a second urging member urges the second surface at the image forming position, and wherein an urging force of the second urging member is not less than an urging force of the first urging member.

57 Claims, 11 Drawing Sheets

IMAGE FORMING APPARATUS

FIELD OF THE INVENTION AND RELATED ART

The present invention relates to an image forming apparatus such as an electrophotographic apparatus or electrostatic recording apparatus. More particularly, it relates to an image forming apparatus in which a toner image is transferred to a recording material carried on a recording material carrying member.

Various types of image forming apparatus are known in which images are formed on recording material. Particularly in a color copying machine, a superimposing transfer type is widely used in which a recording material is carried on a surfaces of recording material carrying means, and plural toner images are transferred onto the same recording material.

As for the recording material carrying means, there is known a transfer drum comprising mutually spaced rings on which a recording material carrying sheet is stretched therebetween into a cylindrical form. The recording material is carried on such a recording material carrying sheet by, for example, a mechanical system using a gripper confining an edge of the recording material, by electrostatic attraction in which case the recording material carrying sheet is a dielectric sheet. In the latter case, an electric charge is applied to the dielectric sheet by an attraction charger so that the recording material is electrostatically attracted on the carrying sheet. From the standpoint of small size and high speed operation, the electrostatic attraction type is advantageous over the mechanical type.

In order to efficiently attract by the electrostatic attraction force, U.S. Ser. No. 447,592 has proposed that a second side of the recording material carrying sheet which is the side opposite from a first side for carrying the recording material, is urged by an urging member, at a position where the recording material is attracted.

U.S. Ser. No. 574,044 has proposed that the recording material carrying sheet is urged by an urging member in order to increase the transfer efficiency also at the image transfer position where the image is transferred from an image bearing member to the recording material.

However, if the recording material carrying sheet is urged at the second side at the attraction position, the recording material carrying sheet is dented inwardly, as shown in FIG. 13, at a position downstream of the attraction position with respect to the recording material movement direction. If the dent extends to the image transfer position, the recording material, together with the recording material carrying sheet, may be away from the photosensitive drum when the toner image is to be transferred from the photosensitive drum to the recording material, and therefore, the transfer operation becomes improper due to toner scattering or the like.

SUMMARY OF THE INVENTION

Accordingly, it is a principal object of the present invention to provide an image forming apparatus and method in which the image transfer operation is proper at the image transfer position.

It is another object of the present invention to provide an image forming apparatus and method in which the recording material reliably contacts the image bearing member at the image transfer position.

According to an aspect of the present invention, there is provided an image forming apparatus and method in which a second urging member for urging the recording material carrying sheet at the image transfer or formation position, is larger than the urging force by the first urging member at a position where the recording material is fed to the recording material carrying sheet.

According to another aspect of the present invention, there is provided an image forming apparatus in which the urging force by a second urging member for urging the recording material carrying sheet at the image transfer position, is larger than the urging force by a first urging member at a recording material attraction position.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
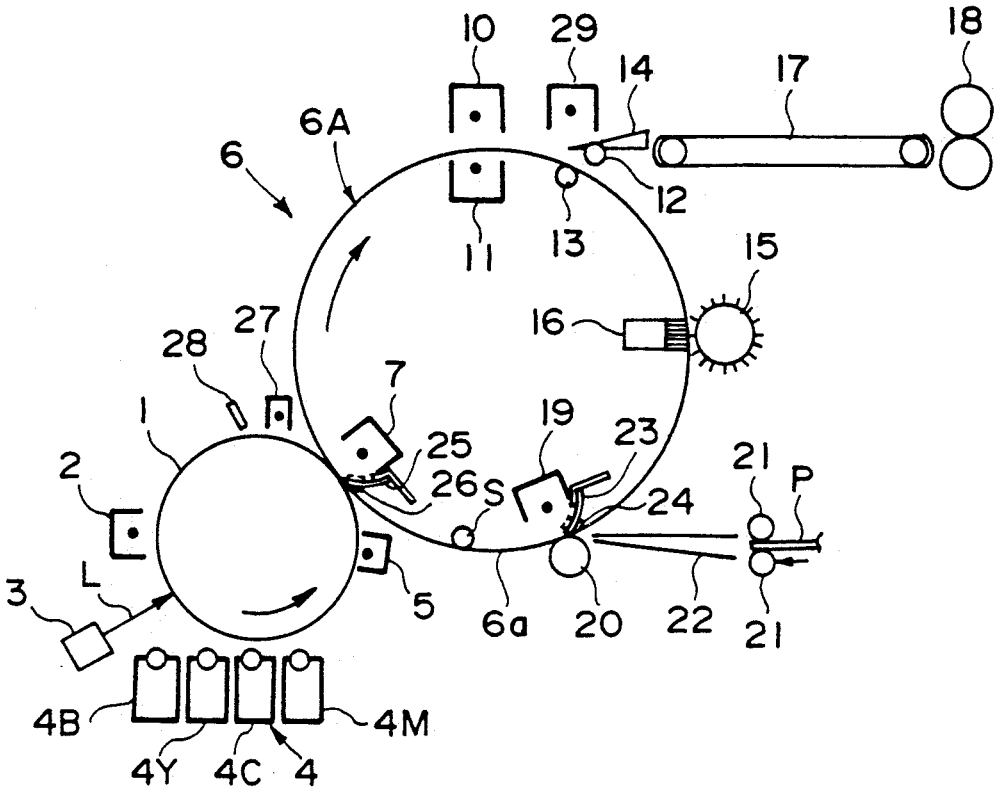
FIG. 1 is a sectional view of an image forming apparatus according to an embodiment of the present invention.

FIG. 1 shows a general arrangement of an image forming apparatus according to an embodiment of the present invention.

The apparatus of FIG. 1 comprises an image bearing member in the form of a photosensitive drum 1, which is supported for rotation about its axis and which is rotated in the direction indicated by an arrow. In this embodiment, the photosensitive drum 1 is rotated at a peripheral speed of 84 mm/sec. Around the photosensitive drum 1, there are disposed to the surface thereof image forming means such as a primary charger 2, an optical system 3, a developing device 4 or the like in the order named in the direction of its rotation.

The primary charger 2 functions to uniformly charge the photosensitive drum 1. The optical system 3 projects at proper timing a color separated light image or a light image L corresponding thereto onto the uniformly charged photosensitive drum 1, so that an electrostatic latent image is formed. The optical system 3 comprises a laser beam exposure device.

The developing device 4 is faced to the surface of the photosensitive drum 4 and is movable in a tangential direction. It contains as developers, magenta toner, cyan toner, yellow toner and black toner in four developing devices 4M, 4C, 4Y and 4B, respectively. Each one of the developing devices which contains the color of the toner corresponding to an electrostatic latent image formed on the photosensitive drum 1, is presented faced to the photosensitive drum 1, and the toner in the developing device is electrostatically transferred to the surface of the photosensitive drum 1, and deposited on the electrostatic latent image on the photosensitive drum 1 so as to develop the electrostatic latent image into a visualized toner image.

Thereafter, the toner image formed on the photosensitive drum 1 is transferred onto a recording material by a transfer charger 7 at an image transfer or formation position. In the image forming position, the transfer charger 7 is opposed to the photosensitive drum 1, and in the position, the toner image is formed on the recording material.

Around the photosensitive drum 1, there are disposed, as shown in FIG. 1, a discharger 27 for removing electrostatic charge from the surface of the photosensitive drum 1, and a cleaning blade 28 for removing the toner therefrom.

Figure 16:
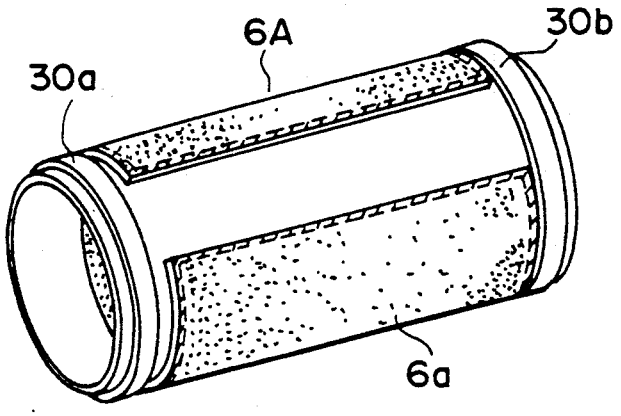
FIG. 16 shows the recording material carrying means.

At the right side of the photosensitive drum 1, there is disposed a transfer drum 6*a* of a recording material carrying means in the form of a transfer device 6, in contact with or a small distance therefrom, the photosensitive drum 1 surface. As shown in FIG. 16, the transfer drum 6*a* includes a pair of ring portions 30*a* and 30*b*. Between the ring portions 30*a* and 30*b* and on the outer peripheries thereof, a film is stretched in a cylindrical form. The film is a flexible recording material carrying member (sheet) 6*a* having a specific dielectric constant of 3.0–13.0, a volume resistivity of $10^9$–$10^{14}$ Ωcm, a thickness of 70–200 μm. It is a dielectric material sheet made of, for example, polyvinylidene fluoride (PVdF) resin material.

As shown in FIG. 1, faced to the backside or inside of the recording material carrying sheet 6*a* (a second surface opposite a first surface for carrying the recording material), there is disposed a transfer charger 7 in the form of a corona charger opposed to the photosensitive drum 1. At a recording material attracting position upstream of the image forming position having the transfer charger 7 with respect to the rotational direction of the transfer drum 6*a*, that is, the recording material conveying direction, an attraction charger 19 in the form of a corona charger is disposed. The recording material attraction position is a position where the electric discharge of the attraction charger 19 is influential. At the outer side of the carrying sheet 6*a* (at the first surface side of the recording material carrying sheet), there is disposed a conductive roller 20 which is brought into contact with the recording material P adjacent the attraction charger 19, if necessary. The recording material P is supplied by a pair of registration rollers 21 as the recording material supplying means to the recording material supply position (attracting position) of the carrying sheet 6*a*, and is electrostatically attracted to and retained on the carrying sheet 6*a* by the attraction electric field produced by the attraction electric charge which is applied to the carrying sheet 6*a* by the corona discharge from the attraction charger 19. The conductive roller 20 may be grounded. The attraction charger or the transfer charger may be in the form of a roller charger.

Downstream of the image forming position or the image transfer position of the carrying sheet 6*a*, there are disposed corona chargers 10 and 11 for electric discharging, sandwiching the carrying sheet 6*a*. In order to separate the recording material P from the carrying sheet 6*a*, there are disposed urging rollers 12 and 13 sandwiching the carrying sheet 6*a*. Adjacent the rollers 12 and 13, there is a separation blade 14. A corona charger 29 of AC corona discharging type may be disposed adjacent the separation blade 14 in order to prevent disturbance of the image due to a separation charge which occurs when the recording material P is separated from the carrying sheet 6*a*.

Further downstream thereof, there is a brush roller 15 for cleaning the recording material carrying surface of the carrying sheet 6*a*, and there is a corona charger or brush type discharger 16 for removing the deposition force (residual coulomb force and Van der Waals force).

The recording material P separated by the separation blade 14 is supplied to a fixing roller 18 on a conveyer belt 17, and a toner image thereon is fixed.

The image forming apparatus comprises a recording material supplying means including registration rollers 21 or the like to supply the recording material P through a guide 22 to the recording material carrying surface (outer surface) of the carrying sheet 6*a*.

As shown in FIG. 1, adjacent the recording material attracting position inside the recording material carrying sheet 6*a*, there is a first urging member 23 extending in the detection of the length of the transfer drum in order to attract and retain the recording material P on the carrying sheet 6*a*. The urging member 23 is made of a flexible material and extends in a downstream direction to the carrying sheet 6a within the electric discharge width of the attraction charger 19. It is elastically contacted to the carrying sheet 6a at the image forming position upon the attraction operation for the recording material P, so that it urges the carrying sheet 6a to press-contact the carrying sheet 6a to the recording material P attracted to and retained on the carrying sheet 6a. Thus, formation of a gap between the recording material P and the carrying sheet 6a is prevented, when it is attracted to and retained on the carrying sheet 6a.

The urging force of the first urging member is larger at the end portions than in the central portion with respect to the longitudinal direction of the urging member (the longitudinal direction of the transfer drum).

The first urging member 23 is made of a synthetic resin material film or another dielectric material such as polyethylene, polypropylene, polyester, polyethylene terephthalate resin material or the like which has a volume resistivity of not less than $10^{10}$ Ωcm, preferably not less than $10^{14}$ Ωcm. It extends over the entirety of the recording material attracting position of the recording sheet 6a in the direction perpendicular to the rotational movement direction. In this embodiment, the urging member 23 is made of polyethylene terephthalate resin film.

The free end of the urging member 23 is elastically urged to the carrying sheet 6a to the second side of the carrying sheet 6a. It is preferable that the urging position is as for upstream as possible, so long as it is in the neighborhood where the conductive roller 20 is contacted to the transfer drum. This is different from the position where the urging effect is maximum.

The maximum urging effect position is a position where the conductive roller 20 is contacted to the recording material carrying sheet 6a in the recording material attracting position or region, as shown in the Figure. However, when the urging member obstructs the application of the electric charge, it is preferable that the contact position of the urging member is as upstream as possible with respect to the recording material conveying direction within the range of the sufficient urging effect, so as to permit efficient corona discharge application from the attraction charger 19 to the carrying sheet 6a. This will be described in detail hereinafter.

The thickness of the urging member 23 is preferably 10 μm–2 mm, further preferably 50–500 μm from the standpoint of proper urging force to the carrying sheet 6a and from the standpoint of avoiding significant influence to the attraction electric field of the attraction charger 19. It has been confirmed that 50–500 μm thickness of the urging member 23 provides satisfactory results.

Figure 2:
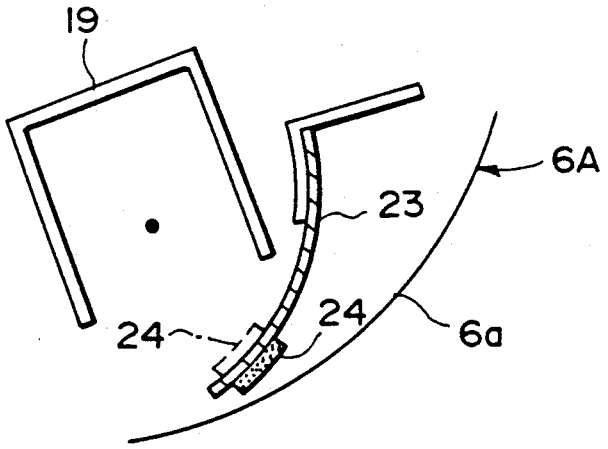
FIG. 2 is a sectional view of an urging member at a recording material attraction position in an image transfer device of an image forming apparatus shown in FIG. 1.
Figure 3:
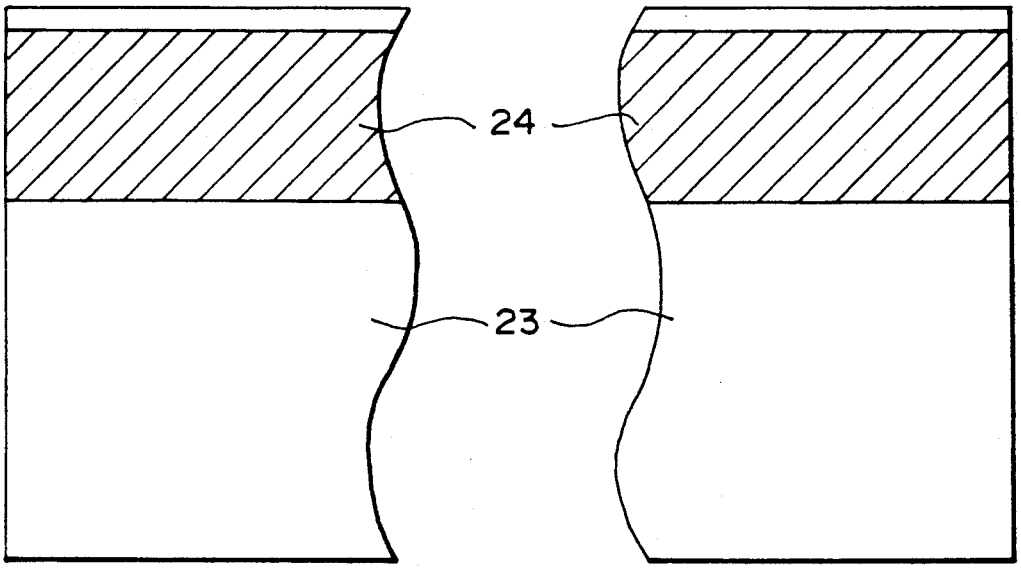
FIG. 3 illustrates provision of an electrically conductive portion of the urging member for the attraction position.

As shown in FIG. 2, the urging member 23 is provided with an electrically conductive portion 24 at its free end. The conductive portion 22 may be disposed on the urging member 23 adjacent the carrying sheet 6a, as shown in FIG. 2, by a solid line, or may be disposed adjacent the attraction charger 19, as indicated by a phantom line.

The effects of the provision of the conductive portion will be described. With the conductive portion 24 on the urging member 23, the electric distance of the electric lines of force extending from the discharging wire of the attraction charger 19 to the carrying sheet 6a, is increased. As a result, the electric current to the carrying sheet 6a is increased, by which the attraction effect is enhanced. Since the conductive portion has a uniform potential in the direction of the length of the urging member, it provides a grid bias funnction, thus permitting uniform attraction electric charge applied on the sheet.

Fundamentally, what is required for the material of the conductive portion 24 is only that the volume resistivity is not more than $10^{10}$ Ωcm. Therefore, the conductive portion 24 may be a mixture, for example, of a high resistance material in which the conductive material is dispersed to provide the above range volume resistivity. A single material conductive portion 24 using a single material satisfying the above volume resistivity, is usable, and it is desirable.

In the production of the conductive portion 24 on the urging member 23, the urging member 23b may be coated with a material constituting the conductive portion 24, or a sheet member is mounted on the urging member 23. The proper method may be selected by one skilled in the art, depending on the material of the conductive portion 24. As an example of the sheet material constituting the conductive portion 24, there are a thin sheet of stainless steel or aluminum foil, for example.

It is preferable that the conductive portion 24 is disposed in the region in which the electric discharge for the attraction actually occurs. In this embodiment, it is extended in 7 mm from a position 1 mm away from the edge contacting the carrying sheet 6a. The thickness of the conductive portion 24 is 30 μm.

As shown in FIG. 1, according to this embodiment, a second urging member 25 extending in a direction of the length of the transfer drum is disposed adjacent the image forming position at a second surface side of the carrying sheet 6a, in order to maintain a close contact between the carrying sheet 6a and the recording material P while the toner image of each of the colors is being transferred onto the recording material P from the photosensitive drum 1. The urging member 25 is made of an elastic material, and is extended downstream to the carrying sheet 6a within the electric discharge region of the transfer charger 7 with respect to the rotational movement direction of the carrying sheet 6a, that is, the recording material carrying direction. It is elastically contacted to the carrying sheet 6a at the image forming position during the image transfer operation, so as to urge the carrying sheet 6a to maintain a continuous close contact between the recording material P and the carrying sheet 6a, by which the occurrence of a gap between the carrying sheet 6a and the recording material P is prevented, when the image transfer operation is being carried out.

The urging force of the second urging member is larger at the end portions than at the central portion with respect to the longitudinal direction of the urging member, as in the case of the first urging member.

Similar to the first urging member 23, the second urging member 25 is made of a synthetic resin film material or another dielectric material such as polyethylene, polypropylene, polyester, polyethylene terephthalate, or a like resin material having a volume resistivity of not less than $10^{10}$ Ωcm, preferably not less than $10^{14}$ Ωm. It covers the entirety of the image transfer region in a direction perpendicular to the rotational movement direction of the carrying sheet 6a. In this embodiment, the second urging member 25 is made of a polyethylene terephthalate resin film.

The free end of the second urging member 25 is elastically urged to the second surface of the carrying sheet 6a adjacent a position where the transfer drum is contacted to the photosensitive drum 1. As long as these conditions are satisfied, it is preferable that the position is as for upstream as possible. This will be described in detail hereinafter.

The thickness of the urging member 25 is preferably 10 μm–2 mm, further preferably 50–500 μm from the standpoint of proper urging force to the carrying sheet 6a and from the standpoint of avoiding significant influence to the transfer electric charge of the transfer charger 7. It has been confirmed that 50–500 μm thickness provides satisfactory results.

As shown in FIG. 1, similar to the urging member 23 at the attraction position, the urging member 25 is provided with a conductive portion 26 at the free end. The conductive portion 26 may be at the carrying sheet 6a side of the urging member 25 or the charger 7 side.

Similarly to the case of the urging member 23, what is basically required for the material of the conductive portion 26 is only that the volume resistivity thereof is not more than $10^{10}$ μcm. It may be a high resistance material in which conductive material is dispersed to satisfy the above volume resistivity. A single material satisfying the volume resistivity is used for the conductive portion 26. The method for the formation of the conductive portion 26 on the urging member 25 may be the same as for the urging member 23 for the attraction position. For example, the material may be applied on the urging member 26, or a sheet material may be bonded to the urging member 25. The proper method may be selected by one skilled in the art. As an example of the sheet material constituting the conductive portion 26, there is a thin sheet of stainless steel or aluminum foil.

The conductive portion 26 may be preferably within the range in which the transfer electric discharge actually occurs. In this embodiment, it is extended in 7 mm from a position 1 mm away from the edge contacting the carrying sheet 6a. The conductive portion 26 had a thickness of 30 μm.

As described in the foregoing, in this embodiment, the first urging member 23 and the second urging member 25 are provided at the recording material attracting position (recording material supply position) and the image forming position, respectively. The urging force of the urging member 25 to the carrying sheet 6a is not less than that of the urging member 23 to the carrying sheet 6a. By doing so, the carrying sheet 6a is prevented from separating from the photosensitive drum in the image forming position or range. Therefore, the contact is reliable between the recording material and the photosensitive drum in the image forming position. Thus, the toner is not scattered, and improper image transfer is prevented, because of the reliable sufficient contact.

The advantageous effects will be further described in detail. The urging member is used in order to enhance the attraction efficiency of the recording material by urging the carrying sheet and the recording material to the conductive roller at the attraction position. When it is made of a dielectric sheet or the like having an electrically insulative property, it is charged up by the attraction charge supplied from the attraction charger. If this occurs, movement of the attraction charge toward the carrying sheet is prevented. In order to guarantee the amount of attraction charge to the carrying sheet, the total electric current to the attraction charger has to be increased. However, this results in an increase of the size of the power source, which is not preferable.

Figure 13:
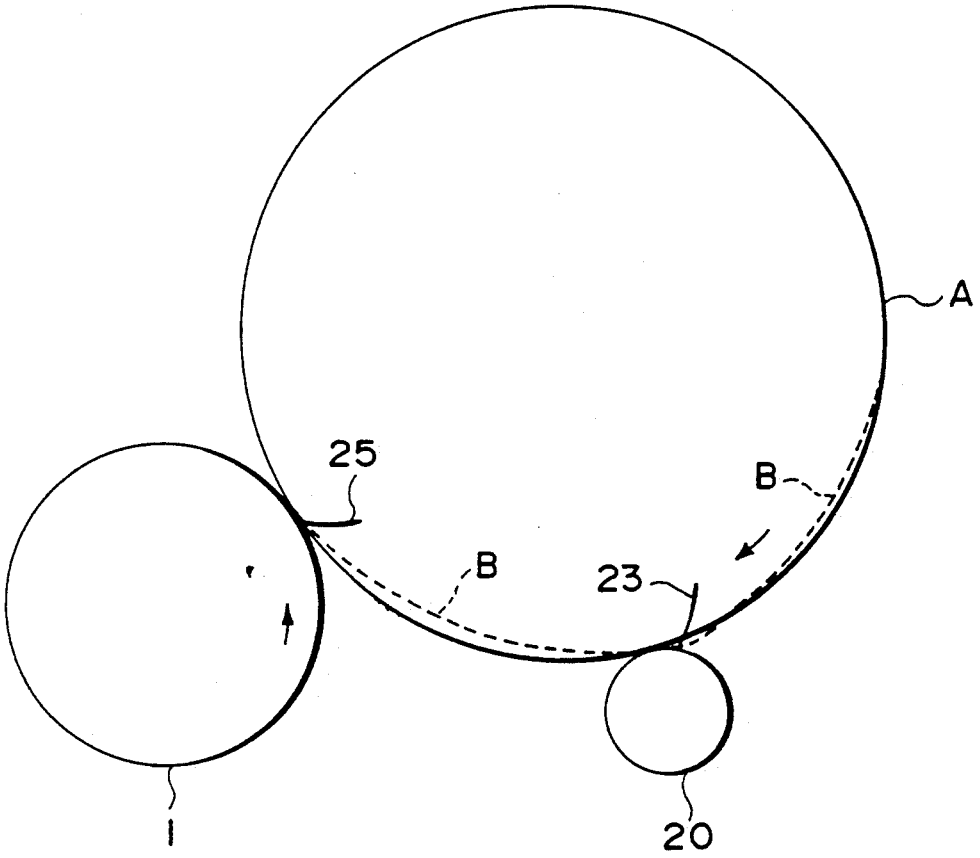
FIG. 13 illustrates the deformation of the recording material carrying sheet by the urging member.

In order to prevent the charge-up and in order to efficiently increase the amount of electric charge to the carrying sheet 6a, the contacting position of the urging member 24 for the attraction position is preferably as far upstream as possible within the neighborhood of the contact position between the conductive roller 20 and the transfer drum. This position is different from the maximum urging effect position. The maximum urging effect position is opposite the contact position between the conductive roller and the transfer drum. This is the position of the maximum charge-up of the urging member. It will be understood that in the position downstream of the contact position between the conductive roller and the transfer drum within the attraction region, it is practically not possible to apply the attraction charge on the carrying sheet. If the contact position of the urging member 23 is different from the contact position between the conductive roller 20 and the transfer drum, the urging effect results in deformation of the carrying sheet toward the conductive roller. As shown in FIG. 13, when the carrying sheet of the transfer drum is deformed at the attracting position to a position outside of the circumference A of the transfer drum, the carrying sheet deforms inwardly at other parts of the circumference, as shown in FIG. 13 by reference B. If the deformation occurs at the transfer position and if the pressure by the transfer urging member disposed at the transfer position is insufficient, the recording material P and the carrying sheet 6a are separated from the photosensitive drum 1 at the transfer position, while the transfer electric field is being formed, with the result of toner scattering and improper image transfer.

Such a deformation occurs as shown in FIG. 13 in which the first deformation occurs at the attraction position. When the image transfer position is close to the attraction position, as shown in FIG. 1, the inward deformation of the carrying sheet 6a occurs at the image transfer position.

In consideration of the above, the embodiment of this invention is such that the pressure by the transfer position urging member 25 at the transfer position or the image forming position or the second deformation position and the pressure by the attracting position urging member 23, are in a predetermined relationship. More particularly, the pressure at the image transfer position is made higher than the pressure at the attracting position (so as to avoid any transfer image disturbance which is produced when the pressure at the transfer position or the second deformation position is not sufficient).

The feature that the urging force of the second urging member is higher than that of the first urging member provides the following advantageous effects. The charge-up of the recording material carrying sheet can be suppressed as compared with the case in which the urging force of the second urging member is lower than that of the first urging member, and therefore, the total amount of the electric current to the transfer charger can be decreased.

Figure 4:
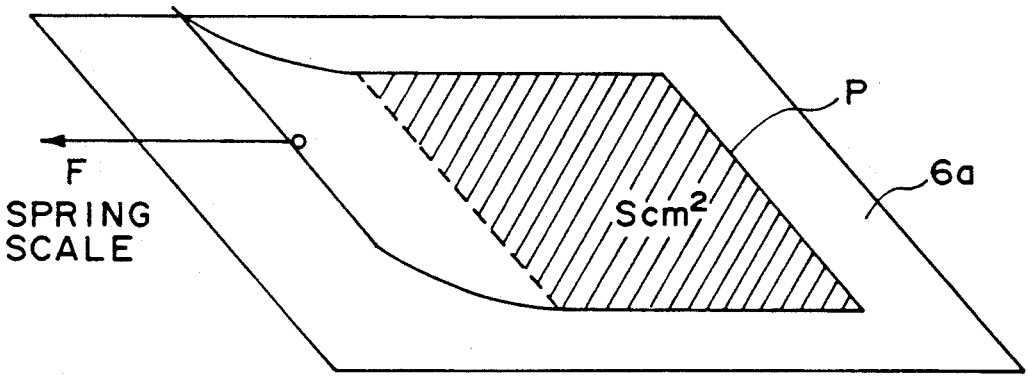
FIG. 4 is a perspective view illustrating a measurement method for measuring a relation between an attraction current and an attraction force for the recording material.

This effect will be described in more detail. FIG. 4 illustrates a method of measuring a relation between the electric current flowing from the attraction charger and the attraction force of the recording material P to the carrying sheet 6a, when the recording material P having a basis weight of 80 g is electrostatically attracted to the recording material carrying sheet 6a by the attraction charger 19, under the condition that the carrying sheet 6a is electrically discharged beforehand by the discharging means 10, 11 or the like shown in FIG. 1 and is urged by the urging member 23. The urging force (g/cm) per unit length of the urging member 23 is changed. It urges to the backside of the carrying sheet 6*a*. An attraction current Iad is supplied to the attraction charger 19 disposed at the same side, while the conductive roller 20 is disposed at the recording material P side. Thus, the recording material P is electrostatically attracted to the carrying sheet 6*a*. Immediately thereafter, the recording material P is pulled in the conveying direction by a spring scale (not shown) attached to a leading end of the recording material P. The critical pulling force F (dyne) is measured when the recording material P starts to slide on the carrying sheet 6*a*. The critical force F is divided by the contact area S ($cm^2$) between the carrying sheet 6*a* and the recording material P. Thus, the attraction force between the carrying sheet 6*a* and the recording material P was determined. The ambient condition was 23° C. and 45% RH. The tests which will be described hereinafter have been carried out under the same ambient conditions.

Figure 5:
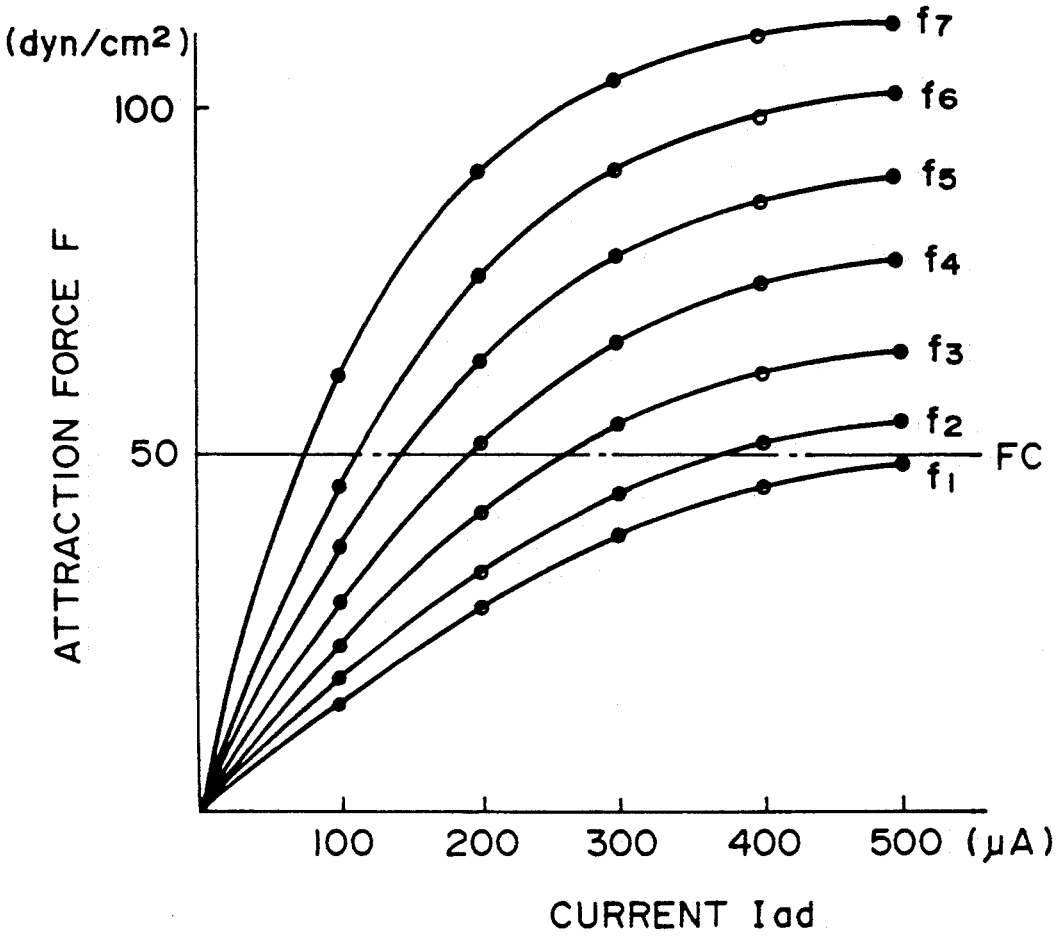
FIG. 5 is a graph showing a relation between an attraction force and an attraction current Iad, which has been determined while changing the urging force to the carrying sheet from the attraction position urging member.

FIG. 5 is a graph showing a relation between the attraction current Iad and the attraction force determined through the above-described method when the urging force of the urging member 23 to the carrying sheet 6*a* is stepwisely changed.

In FIG. 5, curves f1–f7 are plots of the urging forces of f1=6 g/cm, f2=9 g/cm, f3=12 g/cm, f4=15 g/cm, f5=18 g/cm, f6=21 g/cm, and f7=24 g/cm.

A line FC parallel to the abscissa of this graph represent the minimum attraction force required for the recording sheet 6*a* to convey the recording material P. In this embodiment, the minimum attraction force FC is set to be approximately 50 dyne/$cm^2$. In order to determine the practical level of the attraction current Iad, the attraction force F is made slightly larger than FC. This is because the outputs of different power sources vary within a tolerance range.

It will be understood from FIG. 5 that the attraction current providing the attraction force of the carrying sheet 6*a* to the recording material equal to or higher than FC decreases with an incease in the urging force of the urging member 23 to the carrying sheet 6*a*.

Figure 6:
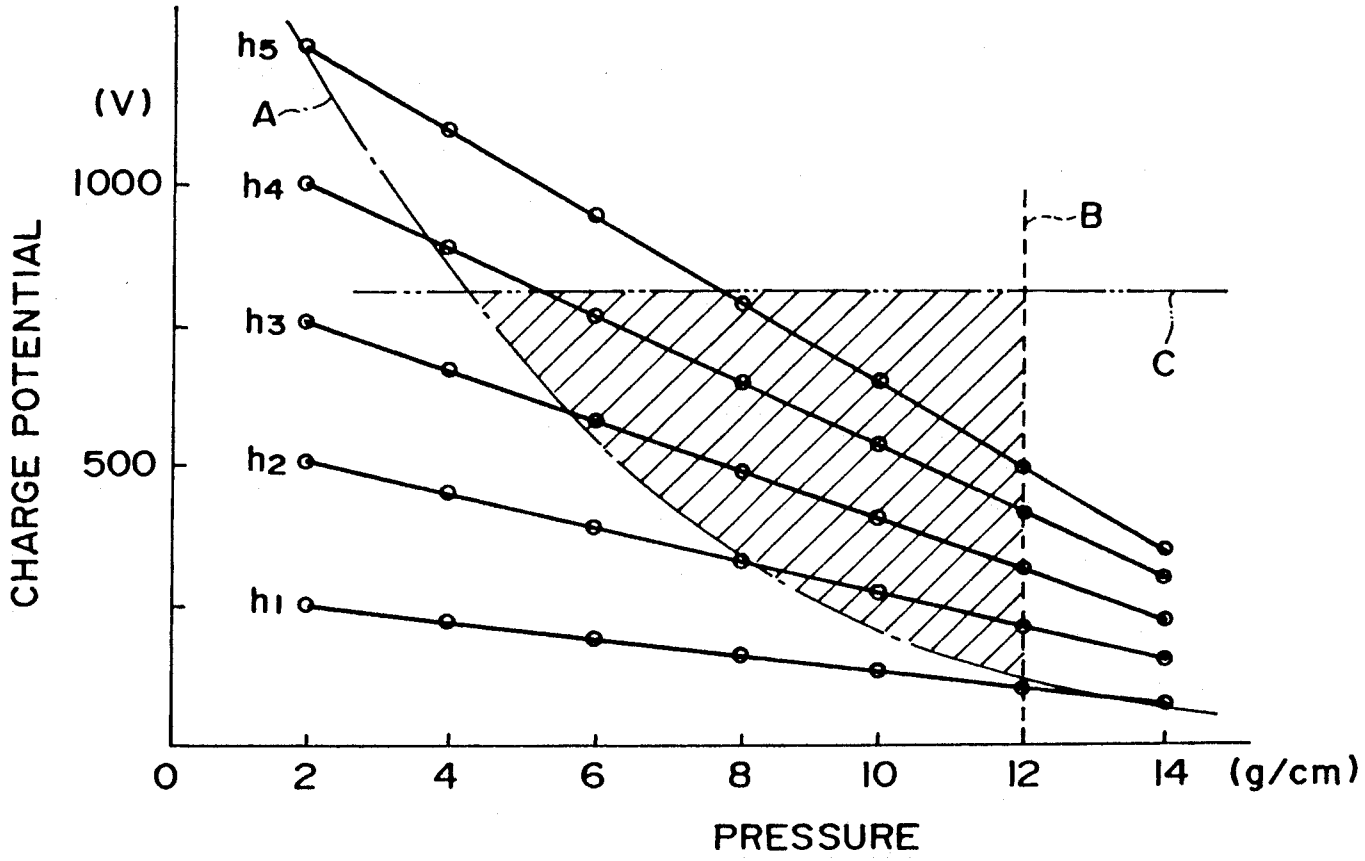
FIG. 6 is a graph showing a relation between the urging force and a charge potential after the recording material is attracted on the carrying sheet.

FIG. 6 is a graph showing a relation between the urging force to the carrying sheet 6*a* and the charge potential after the attraction of the recording material P to the carrying sheet 6*a* measured using a surface potentiometer S in FIG. 1, when the attraction current is stepwisely changed. In FIG. 6, the curves h1–h5 are plots of the attraction current of the attraction charger 19 of h1=100 μA, h2=200 μA, h3=300 μA, h4=400 μA and h5=500 μA.

In FIG. 6 a curve A represents the lower limit of the attraction force for providing the minimum attraction force FC. A line B parallel with the ordinate represents the upper limit of the urging force for preventing occurrence of non-close-contact region between the carrying sheet 6*a* and the recording material P because of the urging force applied for the attraction (the region where the close-contact is not established therebetween).

Experiments of the inventors have revealed that with an urging force larger than 12 g/cm indicated by the line B, the non-close-contact region occurs. More particularly, the non-close-contact region very frequently occurs during the attraction operatin within a range to the right of line B and above curve A.

The non-close-contact region during the attraction operation will be described. In the attracting position, the urging force of the urging member 23 to the carrying sheet 6*a* is larger at the end positions than in the central position in the longitudinal direction of the urging member or the transfer drum, as described hereinbefore. This is in order to provide the required minimum urging force over the entire longitudinal region of the urging member in consideration of the finding that it is difficult to provide the uniform urging force over the entire length, and the urging force becomes smaller in the central portion.

However, when such an urging force is applied to the carrying sheet 6*a* and when the recording material P is supplied between the carrying sheet and the conductive roller 20, the recording material receives forces toward the center from the lateral end portions, with the result that the central portion of the recording material separates from the carrying sheet 6*a* (non-close-contact). Such an insufficient contact state occurs frequently when the urging force is larger than 12 g/cm at the central position.

In view of the foregoing, the urging force at the attracting position is preferably not more than 12 g/cm. Within this range, the urging force at the attracting position is preferably larger. This is because, as will be understood from FIG. 5, the increase of the urging force decreases the attraction current for providing the minimum required attraction force at the attracting position. The required smaller attracting current means lower voltage output of the power source, which is advantageous. In addition, the transfer current required for the superposing image transfer effected after the attraction can be reduced. As will be understood from FIG. 6, the charge potential of the recording material P is lower if the attraction current is smaller. Therefore, the transfer current required at the image forming position (transfer position) may be smaller.

Here, the relation between the urging force and the insufficient contact state at the time of the attraction, is determined on the basis of observation immediately after the attracting operation. For example, the urging force of 12 g/cm and the attraction current of 300 μA results in the attraction force of 55 dyne/$cm^2$. After four color image transfer operations are superposedly carried out, the attraction force is not less than 100 dyne/$cm^2$, but no insufficient contact region is observed in the recording material P. The reason is considered as follows. The recording material P before the attraction before the carrying sheet 6*a* is hardly confined, and therefore, is easily influenced by the urging force of the urging member 23 at the attracting position. On the other hand, the recording material P after being attracted is confined electrostatically on the carrying sheet 6*a*, and therefore, even if it receives the urging force from the urging member 25, the non-close-contact region is not easily produced. It has been found that even if the superposing image transfer operations are carried out with 12 g/cm of the urging force upon the attraction and 12 g/cm upon the image transfer, the non-close-contact portion is produced. Furthermore, when the urging force upon the attraction is 12 g/cm, the non-close-contact portion is produced until the superposing image transfer operations are completed, if the urging force upon the image transfer operation is less than 15 g/cm.

The charge potential of the recording material will be considered in view of the superposing image transfer operations after the attraction operation. The recording material is electrically charged during the image transfer operation as well as during the attracting operation. With the repetition of the image transfer operation, the charge thereof increases. With the increase of the potential of the recording material, the required transfer current during the image transfer operation is increased. From this standpoint, it is preferably that the charge potential of the recording material during the transfer operation is lower.

Figure 9:
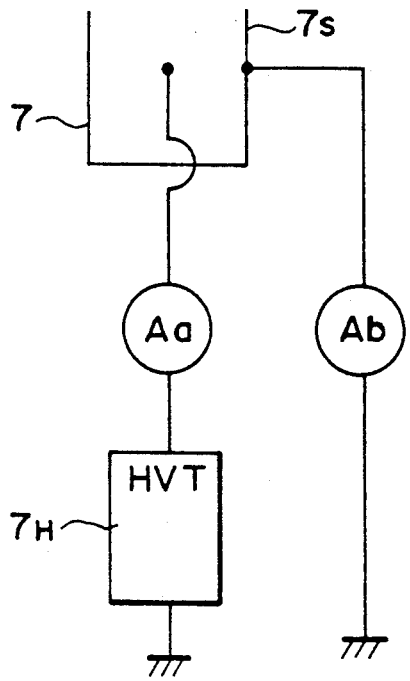
FIG. 9 shows a relation between the total attraction current and the attraction current by the attraction charger.

Referring to FIG. 9, an actually effective transfer current I is:

$$I = Aa - Ab$$

where total transfer current from a high voltage source 7H for the transfer charger 7 is Aa, the electric current flowing through the shield 7S of the charger 7 is Ab.

Figure 7:
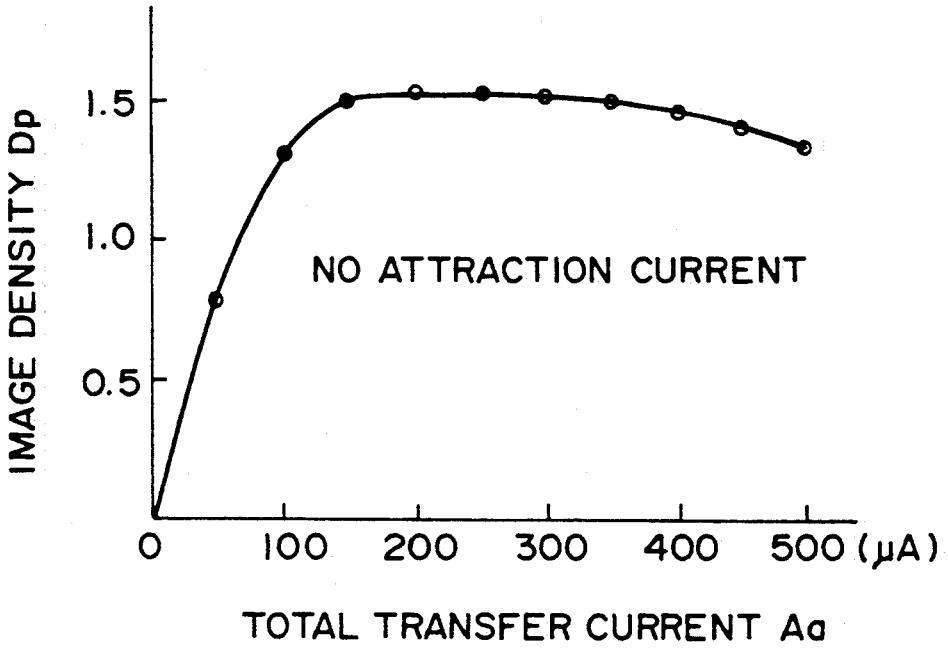
FIG. 7 is a graph showing a relation between the total transfer current and the transfer efficiency when the toner image is transferred from a photosensitive drum to the recording material carried on the carrying sheet, by a transfer charger, without applying the attraction electric charge on the recording material from the attraction charger at the attraction position.
Figure 8:
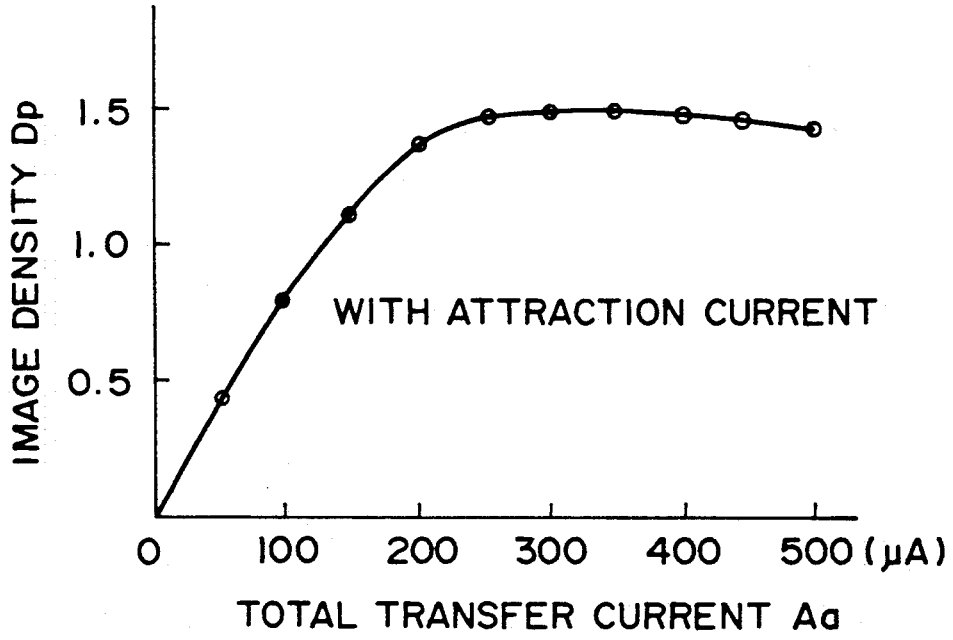
FIG. 8 is a similar graph when the attraction charge is applied.

With the increase of the charge of the recording material, the level Ab increases with the result of a smaller transfer current I. With the relation I=Aa−Ab in mind, the description will be made referring to FIGS. 7, 8 and 10. FIG. 7 is a graph showing a relation between various total transfer currents and the transfer efficiencies when the transfer charger 7 transfers the toner image from the photosensitive drum 1 onto the recording material P retained on the carrying sheets 6*a* without applying attraction charge to the recording material P by the attraction charger 19 at the attracting position. FIG. 8 is a similar graph but when the attraction charge is applied. The transfer current is represented by an image density Dp in the ordinate.

Comparing FIGS. 7 and 8, it will be understood that the transfer efficiency is better when the attraction charge is not applied than when the transfer charge is applied. However, if the effective transfer current I is made the same, that is, if the total transfer current Aa is increased when the attraction charge is applied, the transfer efficiencies are the same irrespective of whether the attraction charge has been applied or not, as shown in FIG. 10.

Thus, it will be understood that when the transfer electric current is effectively applied to the carrying sheet 6*a* during the transfer operation, the transfer current works more effectively if the charge potential of the carrying sheet 6*a* after the attraction (the charge potential of the recording material P) is lower.

Figure 10:
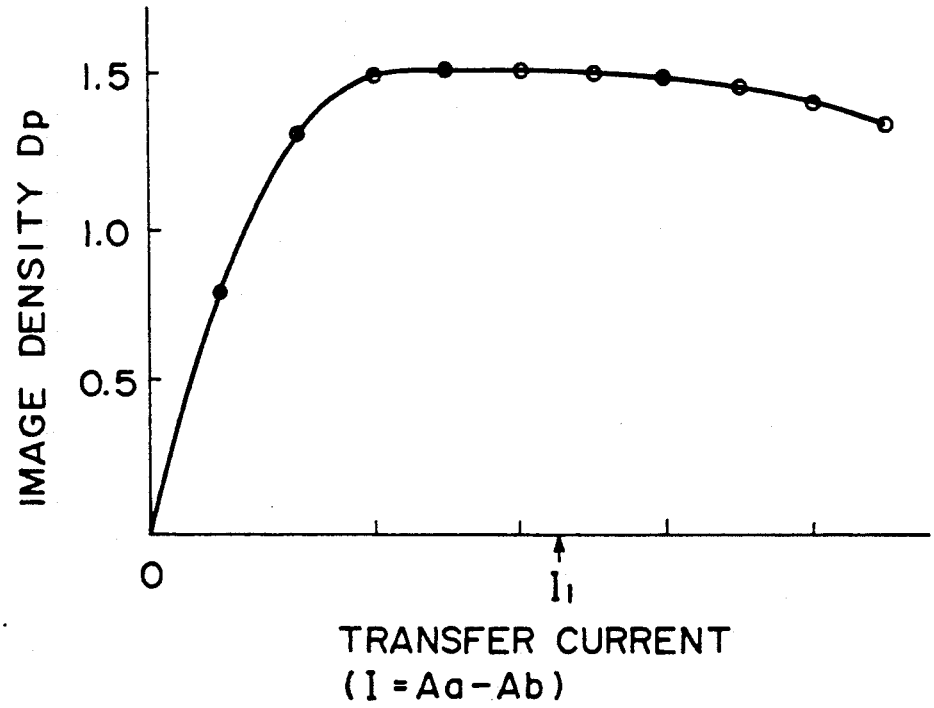
FIG. 10 is a graph showing a relation between the transfer current and the transfer efficiency for each color transfer operation.

In FIG. 10, I1 represents a current contributable to the transfer action to be selected from the range for providing stabilized transfer efficiency, and the total transfer current at this time is the first transfer current.

Similarly to the first image transfer, the transfer current works more effectively if the charge potential of the carrying sheet after the previous charging is lower, for the second, third or fourth, if any, transfer operation for the same recording material.

In FIG. 6, the potentials of the carrying sheet 6*a* at the position S in FIG. 1 between the attracting position and the transfer position were 150, 300, 500, 630 and 760 V when the attraction currents were 100, 200, 300, 400 and 500 μA with a constant urging force of 8 g/cm.

The transfer efficiency relative to the charge of the carrying sheet 6*a* was similar to FIG. 10 in the measurement of the transfer efficiency relative to the current I=Aa−Ab. This means that if the relation is known between the potential of the carrying sheet 6*a* measured at the position S in FIG. 1 and the current A contributable to the image transfer and the total transfer current at this time, then the transfer current for each of the first-fourth color image transfers can be determined.

From FIG. 10 and the results of experiments in which the charge amount of the carrying sheet 6*a* is changed, the optimum range for the electric current contributable to the image transfer (I1 in FIG. 10, for the first image transfer) is I={I1, I2, I3, I4}=5–10 μA.

Figure 11:
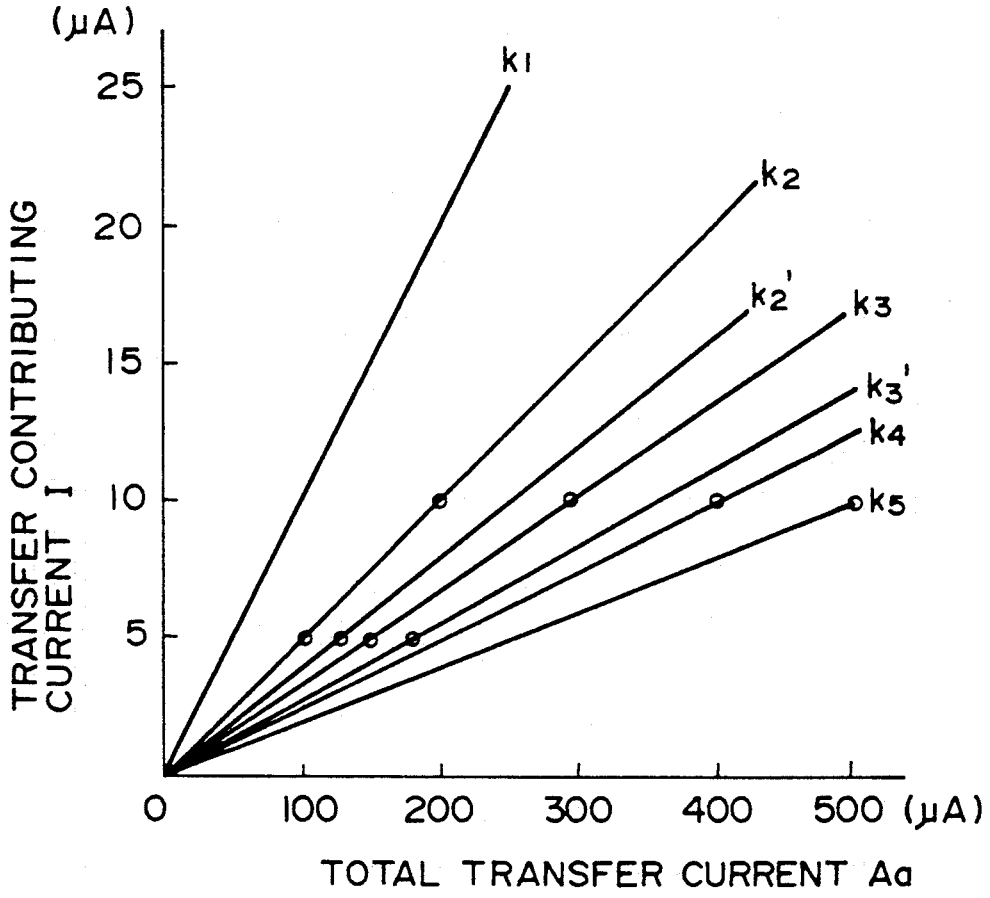
FIG. 11 is a graph showing a relation among the electric current contributable to the image transfer, the total transfer current and the charge potential of the carrying sheet, with a parameter of the charging potential.

FIG. 11 is a graph showing a relation among the current I contributable to the image transfer, the total transfer current Aa and the charge potential of the carrying sheet 6*a*, with the parameter of the charge potential. The abscissa represents the total transfer current Aa, and the ordinate represents the current (I=Aa−Ab) contributable to the image transfer for each of the colors.

In FIG. 11, a parameter K1 represents the case in which the attraction charge is not applied to the carrying sheet 6*a* in the attracting position; K2–K5 represent 300, 500, 700 and 900 V of the charge potential of the carrying sheet 6*a* after the attraction charge application; K2' and K3' represent 400 and 600 V of the charge potential of the carrying sheet 6*a* after the attraction charge application, which are between K2 and K3 and between K3 and K4, respectively.

Focusing on 10 μA of the current I contributable to the image transfer, when the charge potential of the carrying sheet 6*a* after the attraction K2 is 300 V, the transfer current I1=10 μA during the first color image transfer operation with the total transfer current of 200 μA, as will be understood from FIG. 11. As a result, the carrying sheet 6*a* is charged to 500 V. During the second image transfer operation, I2 is 10 μA with the total transfer current of 300 μA. Similarly, in order to provide the transfer currents I3 and I4=10 μA during the third and fourth color transfer operations, the total transfer currents required are 400 and 500 μA, respectively.

As described in the foregoing, according to the experiments of the inventors, the optimum range of the difference among the transfer currents for the respective colors is In=5–10 μA (n=1–4). Investigating the case of In=5 μA, when the total current is 100 μA for the carrying sheet 6*a* charged to 300 V by the first color transfer, the charge potential of the carrying sheet 6*a* is 400 V. With the total transfer current of K1', and the second color transfer is effected with the total transfer current of 123 μA, the transfer current I2=5 μA for the second color image transfer. The resultant charge potential of the carrying sheet 6*a* is 500 V. When the total transfer current of K3 is used, and the third color transfer operation is effected with the total transfer current of 150 μA, the resultant charge potential of the carrying sheet 6*a* is 600 V. Similarly, using the total transfer current K3', the fourth color image transfer is carried out with the total transfer current of 175 μA, the transfer current I4 is 5 μA. From the above, it can be said that the property that the charge potential of the carrying sheet 6*a* after the application of the attraction charge is not easily increased when the urging force of the carrying sheet 6*a* is large at the attracting position generally represents that the increase of the charge potential of the carrying sheet 6*a* after the image transfer operation decreases with an increase of the urging force at the transfer position. Actually, the results which are similar to FIG. 4 showing the relation between the urging force at the attracting position and the charge potential of the carrying sheet 1*a*, are confirmed also between the urging force at the transfer position and the charge potential of the carrying sheet 6a.

Figure 14:
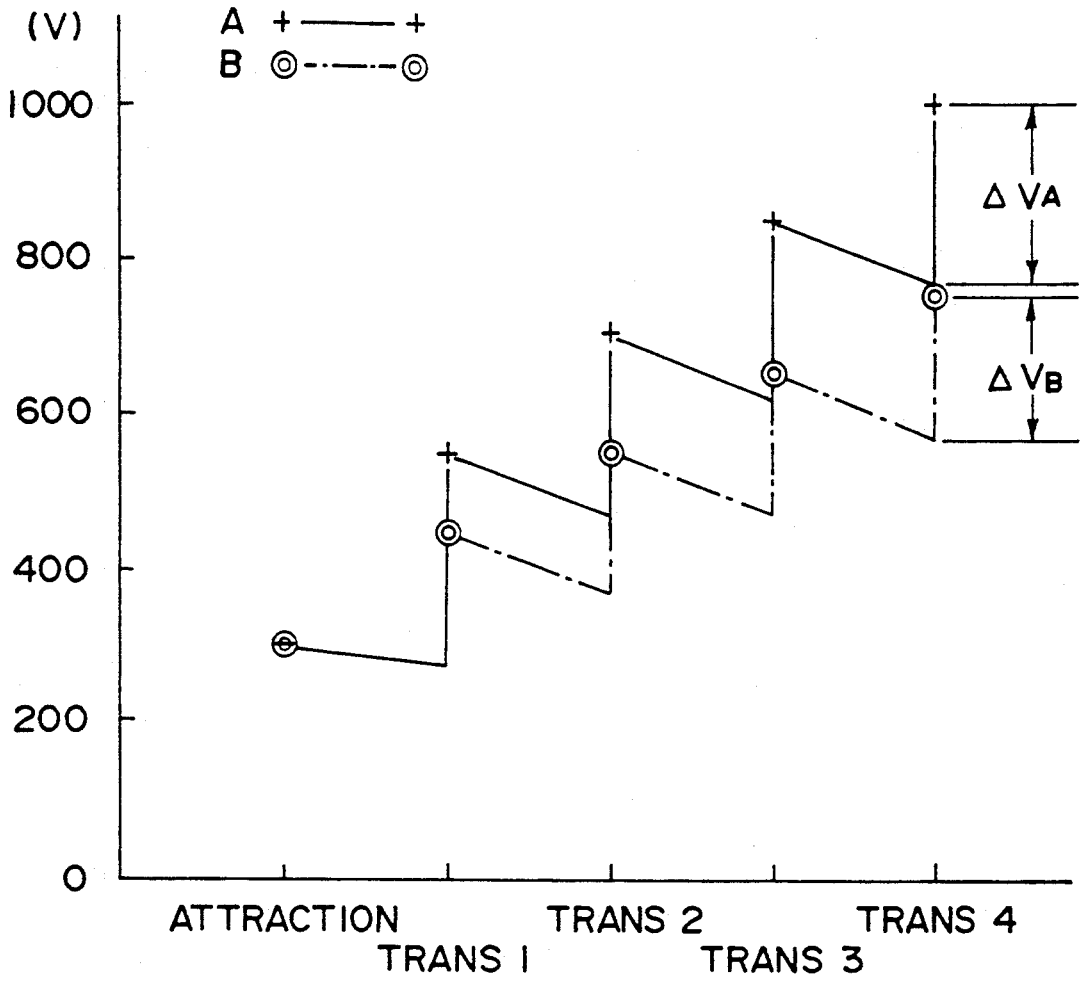
FIG. 14 shows a change of the charge potential of the recording material.

FIG. 14 summarize what has been stated hereinbefore. In the Figure, A represents the case in which the urging force at the attracting position is 8 g/cm; the charge potential of the recording material after the application of the attracting charge is 300 V; the urging force at the image forming position is 8 g/cm; and the transfer current I=Aa−Ab=10 μA. It shows the change in the potential of the recording material. In the Figure B represents the case in which the urging force at the attracting position is 8 g/cm; the charge potential of the recording material after the application of the attraction charge is 300 V; the urging force at the image forming position is 12 g/cm; and the transfer current I=Aa−Ab=10 μA. It also shows the change of the potential of the recording material. The attraction charger 19 and the conductive roller 20 are used only during the attracting operation, and after the recording material is attracted to the carrying sheet 6a, the conductive roller 20 is moved away from the carrying sheet 6a (downward in FIG. 1). Then, immediately before the start of attraction of the next recording material, the conductive roller 20 is contacted to the carrying sheet 6a.

In FIG. 14, the potential of the recording material slightly attenuates in both of the cases A and B until the first image transfer operation after the attraction. The potential of the recording material attenuates more between the first and second transfer operations, between the second and third transfer operations and between the third and fourth transfer operations than between the attraction and the first image transfer operations.

Figure 15A:
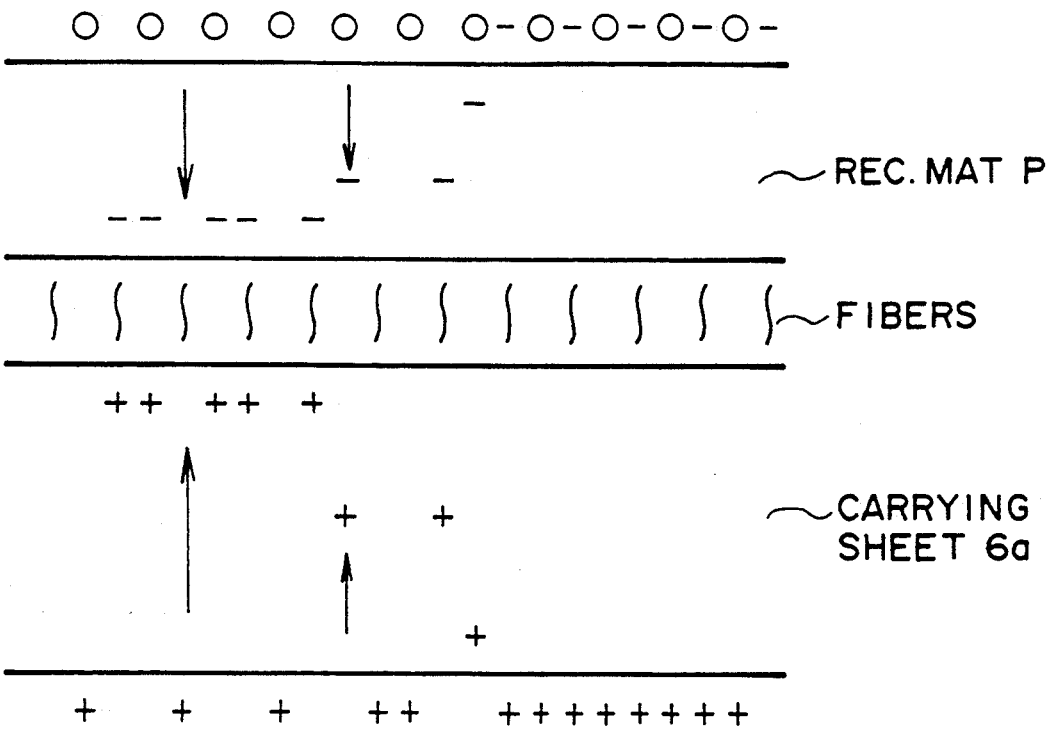
FIGS. 15A and 15B show the states of the recording material carrying sheet surfaces when the recording material carrying sheet is urged by 8 g/cm urging force and 12 g/cm urging force, respectively.
Figure 15B:
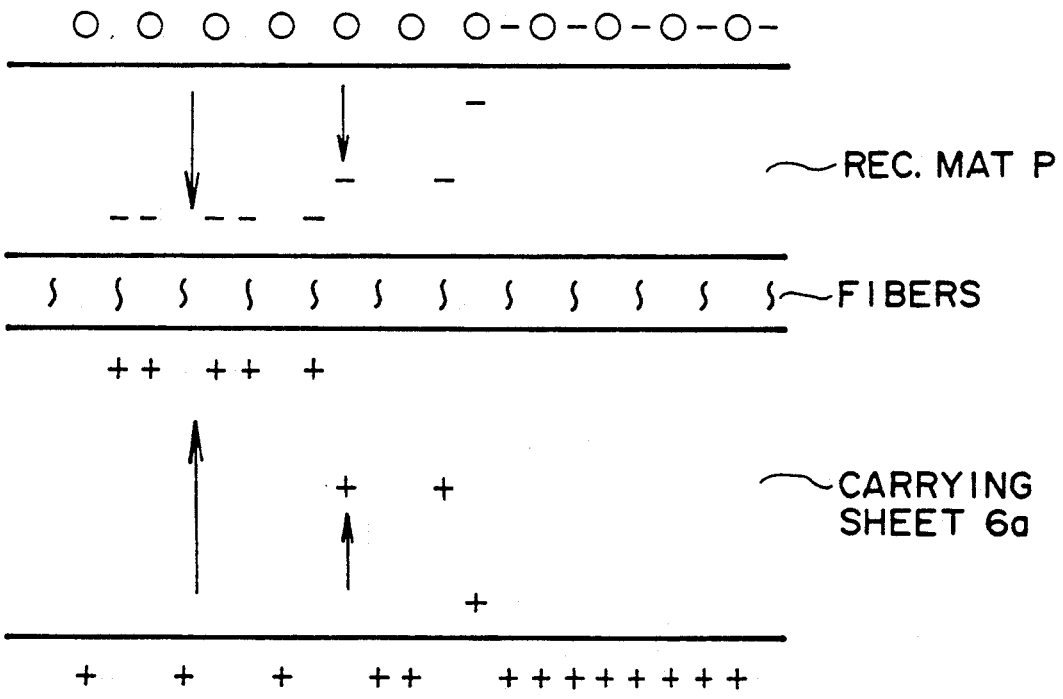

Referring to FIGS. 15A and 15B, the reason for this will be described. FIG. 15A shows the surface state of the recording material P and the carrying sheet 6a in the case A in FIG. 14, and FIG. 15B shows the surface state of the recording material P and the carrying sheet 6a in the case B in FIG. 14. The recording material P is, for example, a sheet of paper having a volume resistivity of approximately $10^{10}$ Ωcm under 20° C. and 60% RH. The polyvinylidene fluoride resin material which is the material of the carrying sheet of this embodiment have a volume resistivity $10^{14}$ Ωcm. And therefore, the attraction charge on the backside of the carrying sheet after the attracting operation and the transfer charge after the image transfer operation ("+" in FIGS. 15A and 15B), are electrically attracted by the electric charge of the toner on the surface of the recording material P and the charge applied by the conductive roller ("o" and "−" in FIGS. 15A and 15B), so that they are moved to the recording material side of the carrying sheet. Among the electric charge on the recording material, the electric charge applied from the conductive roller for the electric attraction are attracted by the electric charge on the carrying sheet and is moved to the surface of the carrying sheet; and among the electric charge which is produced from the air in the neighborhood of the separating position upon separation between the recording material and the transfer drum after passing through the transfer region, the electric charge ("−" in the Figures) deposited on the surface of the recording material by being attracted by the electric charge on the carrying sheet is carried by the electric charge on the carrying sheet and is moved to the surface thereof. This is the reason why the surface potential decreases for each of the transfer operations after the attraction operation. The reason why the attenuations between the first and second transfer operations, between the second and third transfer operations and between the third and fourth transfer operations is larger than the attenuation between the attraction and the first transfer operations, is that the movement distance is longer in the latter case than the former case.

Referring back to FIG. 14, the increase of the potential of the recording material is smaller in case B than in case A in the first, second, third and fourth transfer operations ($\delta V_B < \delta V_A$). This is because the urging force is larger in the image forming position in case B than in case A.

The total thickness of the recording material and the carrying sheet is smaller in case B than in case A since the urging force is larger in case B than in case A (FIGS. 15A and 15B). Considering the carrying sheet and the recording material as a corresponding capacitor, the smaller total thickness in case B results in the larger electrostatic capacity. Therefore, the increase of the potential is smaller in case B even if the same electric charge is applied in the image forming position.

Thus, the potential increase of the recording material is lower in case B providing the larger urging force in the image forming position than in case A, and therefore, the total transfer current Aa can be reduced, which is very advantageous. Furthermore, it is further advantageous to make the urging force in the image forming position larger than the urging force at the attracting position.

As described in the foregoing, in the recording material attracting position, consideration is paid to the sufficient attracting force between the recording material P and the carrying sheet 6a (FC in FIG. 5) and to prevention of the non-close-contact region of the recording material P upon the attracting operation. As regards the transfer position, consideration is paid to suppression of the total transfer current from the first to fourth color transfer operations. In consideration of the above, the charge potential of the carrying sheet 6a is particularly noted such that when the charge potential of the carrying sheet 6a after the attracting operation is high, the urging force to the carrying sheet 6a in the image transfer operation is made equivalent to or higher than the urging force in the attracting position.

Investigating the relation between the urging force in the attracting position to the carrying sheet 6a and the urging force in the transfer position, when the above are satisfied, satisfactory images without improper image quality or improper attraction can be provided when the charge potential of the carrying sheet 6a after the attracting operation is less than approximately 800 V (line C in FIG. 6 parallel to the abscissa).

Therefore, the region defined by lines A, B and C in FIG. 6 is the preferable region according to this embodiment. The region of the urging force to the carrying sheet 6a in the attracting position and the transfer position is approximately 4–12 g/cm. In addition, the urging force in the transfer position is equivalent to or larger than the urging force in the attracting position. In other words, the urging force in the attracting position and the urging force in the transfer position are within 4–12 g/cm, and preferably satisfy the former is equal to or smaller than the latter. The urging force of the second urging member may be increased each transfer operation.

Figure 12:
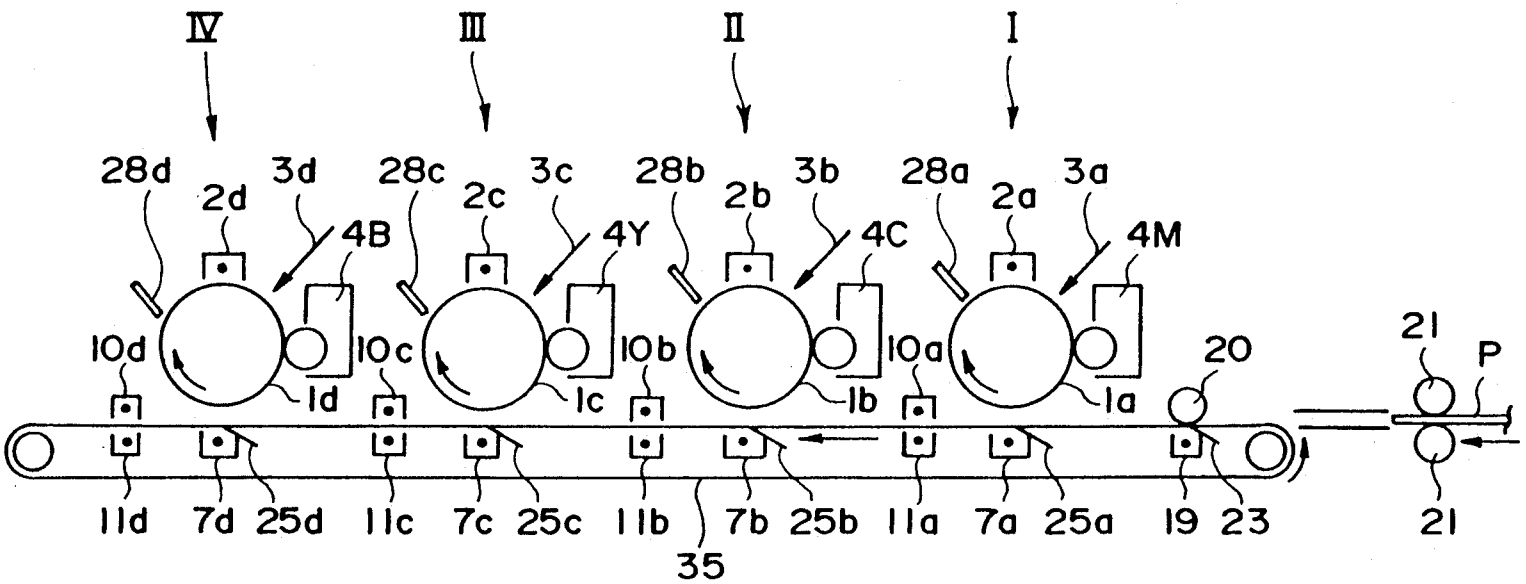
FIG. 12 is a general arrangement of the image forming apparatus according to another embodiment of the present invention.

FIG. 12 shows a general arrangement of an image forming apparatus according to another embodiment of the present invention. The image forming apparatus comprises four juxtaposed image forming units I–IV. Each of the image forming units I–IV comprises a photosensitive drum 1a–1d. Around the photosensitive drums 1a–1d, there are disposed primary chargers 2a–2d, exposure means 3a–3d, developing devices 4M–4B, transfer chargers 7a–7d, charge removing dischargers 10a–10d and 11a–11d and cleaners 28a–28d, respectively. A recording material carrying member is common to all of the image forming units I–IV to constitute the transfer device for all of these units. The recording material carrying member is in the form of an endless dielectric flexible belt 35 extended through the image forming units I–IV below the photosensitive drums 1a–1d.

Adjacent the recording material attracting position where the recording material P supplied by recording material supplying means including a pair of registration rollers 21 or the like is brought into contact with the conveyer belt 35, an attracting charger 19 and an urging member 23 are disposed at the inside of the conveying belt 35 (at the second surface side which is opposite from the first side for carrying the recording material). If necessary, a conductive roller 20 may be provided in facing relation with the attracting charger 19 at an outside (the recording material carrying side) of the conveyer belt 35.

The recording material P supplied to the conveyer belt 35 at the attracting position, is attracted to and retained on the belt 35 electrostatically by the attracting charger 19, and is conveyed through the transferring positions of the photosensitive drums 1a–1d.

In this embodiment, at the inside of the conveyer belt 35 at the recording material attracting position, there is provided a first urging member 23 elastically contacted to the belt 35 within the discharging width of the attracting charger 19, the first urging member extends downstream with respect to the peripheral movement detection of the belt 35. At the inside of the conveyer belt 35 in the image transfer position below each of the photosensitive drums 1a–1d, there is a second urging member 25a–25d elastically contacted to the conveyer belt 35 within the discharging width of the transfer charger 7a–7d, the second urging member 25a–25d extending downstream to the conveyer belt 35.

Similarly to the foregoing embodiment, when the recording material is attracted to and retained on the conveyer belt 35 in the attracting position, the urging member 23 urges the conveyer belt 35; and when an image is transferred from each of the photosensitive drums 1a–1d onto the recording material P in the respective transfer positions, the conveyer belt 35 is urged by the associated urging members 25a–25d.

Similarly, in this embodiment, the urging force of the urging members 23, 25a–25d is selected within a range of 4–12 g/cm, and the urging force of the transfer position urging member 25a–25d is made equivalent to or larger than the urging force of the attracting position urging member 23, and therefore, the increase of the charge potential of the carrying sheet 6a due to the application of the transfer charger in the transfer position is suppressed so that the charging-up of the carrying sheet 6a can be prevented, even if the assured attraction between the recording material P and the carrying sheet 35 without the gap therebetween, is accomplished by increasing the attracting charge of the attracting means without increasing the urging force of the attraction position urging member 23. Accordingly, the plural toner images are properly transferred onto the recording material superimposedly, and therefore, good quality color images can be provided.

The urging force of the second urging members may be increased in the direction of the movement of the conveying belt 35.

As described in the foregoing, according to the present invention, the urging force of the second urging member in the image forming position is made larger than the urging force of the first urging member in the recording material attracting position (recording material supply position), and therefore, the recording material carrying member is not dented or deformed inwardly, by which in the image forming position, the close-contact between the recording material and the image bearing member is assured (when the recording material is not present in the image forming position, the recording material carrying member is contacted to the image bearing member) so that an improper image transfer operation can be prevented.

Further, according to the present invention, the charge-up of the recording material due to the superposed image transfer operations, can be minimized. This permits a lower voltage to be applied to the transfer charger and is economically advantageous. In the foregoing, the color copying machine of a superposed transfer type has been described. However, the present invention is not limited to this but is applicable to a color image forming apparatus of a simultaneous transfer type in which plural toner images are superposedly formed on the image bearing member and are simultaneously transferred onto the recording material. Also, this invention is applicable to a monochromatic image forming apparatus.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

image forming means for forming an image on a recording material in an image forming position;

recording material feeding means for feeding the recording material to said image forming position, said recording material feeding means including a recording material carrying member for carrying the recording material;

supply means for supplying the recording material to said recording material carrying member at a recording material supply position;

a first urging member for urging a second surface of said recording material carrying member which is opposite a first surface thereof for carrying the recording material in the recording material supply position and;

a second urging member for urging the second surface at the image forming position;

wherein an urging force of said second urging member is not less than an urging force of said first urging member.

2. An apparatus according to claim 1, wherein said image forming means comprises an image bearing member and transfer means for transferring an image from said image bearing member onto the recording material in said image forming position.

3. An apparatus according to claim 2, wherein said image bearing member is disposed adjacent the first surface, and wherein said transfer means includes a transfer charger disposed adjacent the second surface and faced to said image bearing member.

4. An apparatus according to claim 1, wherein the recording material is contacted to said image bearing member when the recording material passes through said image forming position.

5. An apparatus according to claim 4, wherein said image bearing member is in contact with said recording material carrying member when the recording material is not present in the image forming position.

6. An apparatus according to claim 1, further comprising attracting means for electrostatically attracting the recording material to said recording material carrying member.

7. An apparatus according to claim 6, wherein said attracting means is disposed upstream of the image forming position with respect to a feeding direction of the recording material.

8. An apparatus according to claim 6, wherein said attracting means includes a corona charger.

9. An apparatus according to claim 8, wherein said attracting means is in contact with said recording material carrying member and includes an electrically conductive roller faced to said corona charger with said recording material carrying member therebetween.

10. An apparatus according to claim 8, wherein said attracting charger is disposed adjacent the second surface.

11. An apparatus according to claim 8, wherein said image bearing member is disposed adjacent the first surface, and wherein said transfer means includes a transfer charger disposed adjacent the second surface and faced to said image bearing member.

12. An apparatus according to claim 11, wherein said attracting charger has a charging polarity which is the same as a charging polarity of said transfer charger.

13. An apparatus according to claim 1, wherein said recording material feeding means includes a pair of rings, and said recording material carrying member is a sheet stretched on and between the rings into a cylindrical form.

14. An apparatus according to claim 13, wherein the sheet is composed of a dielectric material.

15. An apparatus according to claim 1, wherein each of said first urging member and said second urging member is a sheet.

16. An apparatus according to claim 15, wherein each of said first urging member and second urging member is composed of a dielectric material.

17. An apparatus according to claim 1, wherein an urging force of each of said first and second urging members is larger at end portions thereof than at a central portion thereof with respect to a longitudinal direction of the urging member.

18. An apparatus according to claim 1, wherein an urging force of said first urging member is approximately 4–12 g/cm.

19. An apparatus according to claim 1, wherein each of said first and second urging members extends in a downstream direction with respect to a feeding direction of the recording material, and urges said carrying member in the supply position and the image forming position, respectively.

20. An apparatus according to claim 9, wherein said conductive roller is in contact with said recording material carrying member immediately before attraction of the recording material is started.

21. An apparatus according to claim 9, wherein said conductive roller is moved away from said recording material carrying member after attraction of the recording material is completed.

22. An apparatus according to claim 2, wherein said transfer means transfers plural images onto a single recording material.

23. An apparatus according to claim 22, wherein an urging force of said second urging member is increased for a successive image transfer operation.

24. An apparatus according to claim 22, wherein the image is made of a color toner.

25. An apparatus according to claim 1, further comprising a plurality of image forming means each for forming an image on a recording material in an image forming position.

26. An apparatus according to claim 25, further comprising a plurality of second urging members each for urging the second surface at respective image forming positions of said plural image forming means.

27. An apparatus according to claim 26, wherein each said image forming means comprises an image bearing member and transfer means for transferring an image from said image bearing member onto the recording material in said respective image forming positions.

28. An apparatus according to claim 27, wherein respective urging forces of said plural second urging members increase in a downstream direction with respect to a recording material feeding direction.

29. An apparatus according to claim 26, wherein the image is made of a color toner.

30. An image forming apparatus, comprising:

image forming means for forming an image on a recording material in an image forming position;

recording material feeding means for feeding the recording material to said image forming position, said recording material feeding means including a recording material carrying member for carrying the recording material;

attracting means for attracting the recording material to said recording material carrying member in a recording material attracting position;

a first urging member for urging a second surface of said recording material carrying member which is opposite a first surface for carrying the recording material, at the recording material attracting position; and a second urging member for urging the second surface at the image forming position;

wherein an urging force of said second urging member is not less than an urging force of said first urging member.

31. An apparatus according to claim 30, wherein said image forming means comprises an image bearing member and transfer means for transferring an image from said image bearing member onto the recording material in said image forming position.

32. An apparatus according to claim 31, wherein said image bearing member is disposed adjacent the first surface, and wherein said transfer means includes a transfer charger disposed adjacent the second surface and faced to said image bearing member.

33. An apparatus according to claim 30, wherein the recording material is contacted to said image bearing member when the recording material passes through said image forming position.

34. An apparatus according to claim 33, wherein said image bearing member is in contact with said recording material carrying member when the recording material is not present in the image forming position.

35. An apparatus according to claim 30, wherein said attracting means is disposed upstream of the image forming position with respect to a feeding direction of the recording material.

36. An apparatus according to claim 30, wherein said attracting means includes a corona charger.

37. An apparatus according to claim 36, wherein said attracting means is in contact with said recording material carrying member and includes an electrically conductive roller faced to said corona charger with said recording material carrying member therebetween.

38. An apparatus according to claim 36, wherein said corona charger is disposed adjacent the second surface.

39. An apparatus according to claim 36, wherein said image bearing member is disposed adjacent the first surface, and wherein said transfer means includes a transfer charger disposed adjacent the second surface and faced to said image bearing member.

40. An apparatus according to claim 39, wherein said corona charger has a charging polarity which is the same as a charging polarity of said transfer charger.

41. An apparatus according to claim 30, wherein said recording material feeding means includes a pair of rings, and said recording material carrying member is a sheet stretched on and between the rings into a cylindrical form.

42. An apparatus according to claim 41, wherein the sheet is composed of a dielectric material.

43. An apparatus according to claim 30, wherein each of said first urging member and said second urging member is a sheet.

44. An apparatus according to claim 43, wherein each of said first urging member and second urging member is composed of a dielectric material.

45. An apparatus according to claim 30, wherein an urging force of each of said first and second urging members is larger at end portions thereof than at a central portion thereof with respect to a longitudinal direction of the urging member.

46. An apparatus according to claim 30, wherein an urging force of said first urging member is approximately 4–12 g/cm.

47. An apparatus according to claim 30, wherein each of said first and second urging members extends in a downstream direction with respect to a feeding direction, and urges said recording material carrying member at the attracting position and the image forming position, respectively.

48. An apparatus according to claim 37, wherein said conductive roller is in contact with said recording material carrying member immediately before attraction of the recording material is started.

49. An apparatus according to claim 37, wherein said conductive roller is moved away from said recording material carrying member after attraction of the recording material is completed.

50. An apparatus according to claim 31, wherein said transfer means transfers plural images onto a single recording material.

51. An apparatus according to claim 50, wherein an urging force of said second urging member is increased for a successive image transfer operation.

52. An apparatus according to claim 50, wherein the image is made of a color toner.

53. An apparatus according to claim 30, further comprising a plurality of image forming means each for forming an image on a recording material in an image forming position.

54. An apparatus according to claim 53, further comprising a plurality of second urging members each for urging the second surface at respective image forming positions of said plural image forming means.

55. An apparatus according to claim 54, wherein each said image forming means comprises an image bearing member and transfer means for transferring an image from said image bearing member onto the recording material in said respective image forming positions.

56. An apparatus according to claim 55, wherein respective urging forces of said plural second urging members are increased in a downstream direction with respect to a recording material feeding direction.

57. An apparatus according to claim 54, wherein the image is made of a color toner.

* * * * *

UNITED STATES PATENT AND TRADEMARK OFFICE

CERTIFICATE OF CORRECTION

PATENT NO. : 5,172,172

DATED : December 15, 1992

INVENTOR(S) : AMEMIYA et al.

It is certified that error appears in the above-indentified patent and that said Letters Patent is hereby corrected as shown below:

Title page, item

[56] References Cited

"5,081,501 1/1991 Waki et al." should read --5,081,501 1/1992 Waki et al.--.

Insert:

--Attorney, Agent or Firm - Fitzpatrick, Cella, Harper & Scinto--

Title page, item

[57] Abstract

Line 15, "and" should be deleted.

COLUMN 1

Line 16, "surfaces" should read --surface--.

COLUMN 4

Line 65, "detection" should read --direction--.

COLUMN 5

Line 1, "to" should read --of--.
Line 30, "for" should read --far--.
Line 40, "as" should read --as far--.

UNITED STATES PATENT AND TRADEMARK OFFICE

CERTIFICATE OF CORRECTION

PATENT NO. : 5,172,172

DATED : December 15, 1992

INVENTOR(S) : AMEMIYA et al.

It is certified that error appears in the above-indentified patent and that said Letters Patent is hereby corrected as shown below:

COLUMN 6

Line 22, "are" should read --is--.

COLUMN 7

Line 4, "for" should read --far--.
Line 21, "$10^{10}$ $\mu$cm." should read --$10^{10}$ $\Omega$cm.--
Line 39, "had" should read --has--.

COLUMN 9

Line 32, "sent" should read --sents--.
Line 67, "operatin" should read --operation--.

COLUMN 11

Line 8, "preferably" should read --preferable--.

COLUMN 12

Line 53, "150 $\mu$A, the" should read --150 $\mu$A, the transfer current I3 for the third color is 5 $\mu$A. The--.

COLUMN 13

Line 3, "summarize" should read --summarizes--.
Line 11, "Figure B" should read --Figure, B--.
Line 56, "are" should read --is--.

UNITED STATES PATENT AND TRADEMARK OFFICE

CERTIFICATE OF CORRECTION

PATENT NO. : 5,172,172

DATED : December 15, 1992

INVENTOR(S) : AMEMIYA et al.

It is certified that error appears in the above-indentified patent and that said Letters Patent is hereby corrected as shown below:

COLUMN 14

Line 4, "is" should read --are--.
Line 63, "is" should read --as--.

COLUMN 16

Line 58, "position and;" should read --position; and--.

Signed and Sealed this

First Day of February, 1994

Bruce Lehman

*Attest:*

BRUCE LEHMAN

*Attesting Officer*

*Commissioner of Patents and Trademarks*